US008997473B2

(12) United States Patent
Olson et al.

(10) Patent No.: US 8,997,473 B2
(45) Date of Patent: Apr. 7, 2015

(54) ELECTRO-HYDRAULIC ACTUATOR

(75) Inventors: Matthew Olson, Maple Grove, MN (US); James Prazak, White Bear Lake, MN (US)

(73) Assignee: Parker Hannifin Corporation, Cleveland, OH (US)

( * ) Notice: Subject to any disclaimer, the term of this patent is extended or adjusted under 35 U.S.C. 154(b) by 924 days.

(21) Appl. No.: 13/091,579

(22) Filed: Apr. 21, 2011

(65) Prior Publication Data

US 2011/0289912 A1 Dec. 1, 2011

Related U.S. Application Data

(60) Provisional application No. 61/326,895, filed on Apr. 22, 2010.

(51) Int. Cl.

| | |
|---|---|
| ***F15B 21/04*** | (2006.01) |
| ***F15B 7/00*** | (2006.01) |
| ***F15B 15/18*** | (2006.01) |

(52) U.S. Cl.

CPC ..... *F15B 7/006* (2013.01); *F15B 15/18* (2013.01); *F15B 2211/20561* (2013.01); *F15B 2211/27* (2013.01); *F15B 2211/3051* (2013.01); *F15B 2211/40515* (2013.01); *F15B 2211/50518* (2013.01)

(58) Field of Classification Search

USPC ..... 60/329, 473–476, 468, 494; 91/437

See application file for complete search history.

(56) References Cited

U.S. PATENT DOCUMENTS

| | | | | | |
|---|---|---|---|---|---|
| 2,657,533 | A | * | 11/1953 | Schanzlin et al. | 60/476 |
| 3,113,432 | A | | 12/1963 | Watson | |
| 3,200,592 | A | | 8/1965 | Nix | |
| 3,603,083 | A | | 9/1971 | Coursen | |
| 3,761,735 | A | | 9/1973 | Turner et al. | |
| 3,903,698 | A | * | 9/1975 | Gellatly et al. | 60/476 |
| 4,117,678 | A | | 10/1978 | Turner et al. | |
| 4,149,382 | A | | 4/1979 | Holsomback | |
| RE33,201 | E | | 4/1990 | Dickinson | |
| 4,961,316 | A | * | 10/1990 | Corke et al. | 60/476 |
| 5,144,801 | A | | 9/1992 | Scanderbeg et al. | |
| 5,285,642 | A | * | 2/1994 | Watanabe et al. | 60/452 |
| 6,256,987 | B1 | * | 7/2001 | Stolle | 60/476 |
| 7,281,372 | B2 | * | 10/2007 | Sakai et al. | 60/476 |
| 8,033,107 | B2 | * | 10/2011 | Tikkanen | 60/476 |

* cited by examiner

*Primary Examiner* — F. Daniel Lopez

(74) *Attorney, Agent, or Firm* — Renner, Otto, Boisselle & Sklar, LLP

(57) ABSTRACT

An electro-hydraulic actuator (EHA) includes a hydraulic circuit having a plurality of pressure compensated flow control valves for limiting the maximum flow rate through the fluid conduits regardless of the loads imparted on the actuator. In one embodiment of the EHA, a plurality of combination manual override/thermal expansion valves that simplify the manufacture of the EHA.

18 Claims, 8 Drawing Sheets

Manual valve and Thermal Valve Closed.

Manual valve and Thermal Valve Closed.

Manual Valve Opened and Thermal Valve Closed

Manual Valve Closed and Thermal Valve Open

ELECTRO-HYDRAULIC ACTUATOR

CROSS REFERENCE TO RELATED APPLICATIONS

The present application claims the benefit of the filing date of U.S. Provisional Patent Application Ser. No. 61/326,895, filed Apr. 22, 2010, the disclosure of which is incorporated herein by reference in its entirety.

BACKGROUND OF THE INVENTION

Electro-hydraulic actuators are generally known. A typical electro-hydraulic actuator includes an electric motor that drives a hydraulic pump to move fluid from a reservoir to a hydraulic actuator for actuating the actuator. When the electric motor is driven in a first rotational direction, the hydraulic fluid moved by the hydraulic pump extends a rod of the actuator. When the electric motor is driven in a second rotational direction, opposite the first rotational direction, the hydraulic fluid moved by the hydraulic pump retracts the rod of the actuator.

The components of an electro-hydraulic actuator are supported in a housing. The housings of many known electro-hydraulic actuators include a first portion for the actuator and a second portion, connected to the first portion, for the electric motor, hydraulic pump, and reservoir. Fluid passages are formed in the housing such that a complete hydraulic circuit is contained within the housing. The portion of the housing including the fluid passages is commonly referred to as the manifold.

SUMMARY

At least one embodiment of the invention provides an electro-hydraulic actuator comprising: a hydraulic pump; an electric motor operatively connected to the hydraulic pump and operable for driving the pump; an actuator moveable in response to fluid flow from the pump, the actuator including a piston movable in a cylinder and defining a piston side chamber and a rod side chamber; a housing for the pump, electric motor and actuator and including a reservoir, the housing including a manifold with fluid conduits for connecting the reservoir, the pump and the piston side and rod side chambers of the actuator; and a plurality of pressure compensated flow control valves for limiting the maximum flow rate through the fluid conduits regardless of the loads imparted on the actuator.

At least one embodiment of the invention provides an electro-hydraulic actuator comprising: a hydraulic pump; an electric motor operatively connected to the hydraulic pump and operable for driving the pump; an actuator moveable in response to fluid flow from the pump, the actuator including a piston movable in a cylinder and defining a piston side chamber and a rod side chamber; a housing for the pump, electric motor and actuator and including a reservoir, the housing including a manifold with fluid conduits for connecting the reservoir, the pump and the piston side and rod side chambers of the actuator; and a filter for filtering fluid as the fluid returns to the reservoir from the actuator.

At least one embodiment of the invention provides an electro-hydraulic actuator comprising: a hydraulic An electro-hydraulic actuator having: a hydraulic pump; an electric motor operatively connected to the hydraulic pump and operable for driving the pump; an actuator moveable in response to fluid flow from the pump, the actuator including a piston movable in a cylinder and defining a piston side chamber and a rod side chamber, a housing for the pump, electric motor and actuator and including a reservoir, the housing including a manifold with fluid conduits for connecting the reservoir, the pump and the piston side and rod side chambers of the actuator; and a plurality of combination manual release, thermal expansion valves received in the manifold.

BRIEF DESCRIPTION OF THE DRAWINGS

Embodiments of this invention will now be described in further detail with reference to the accompanying drawing, in which.

DETAILED DESCRIPTION OF THE DRAWINGS

Figure 1:
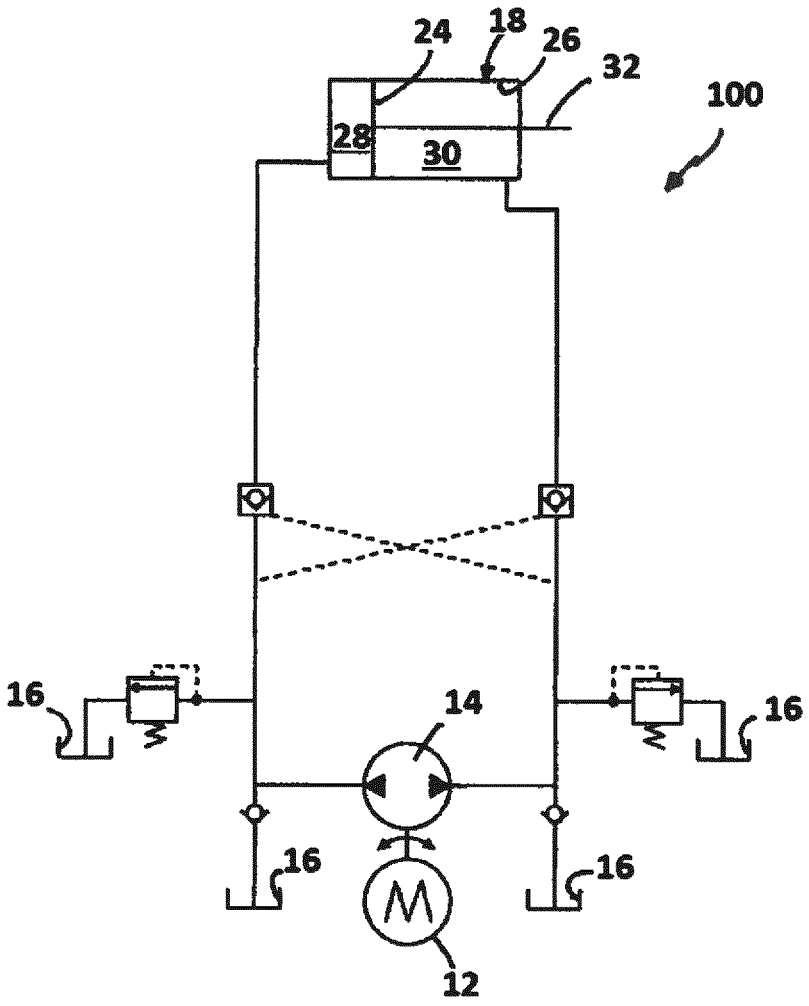
PRIOR ART FIG. 1
FIG. 1 schematic illustration of a hydraulic circuit of a conventional electro-hydraulic actuator.

FIG. 1 is a schematic illustration of a conventional electro-hydraulic actuator 100. The electro-hydraulic actuator 100 includes an electric motor 12 that is operatively coupled to a hydraulic pump 14. The electric motor 12 is operable for driving the hydraulic pump 14 in opposite first and second rotational directions for driving the hydraulic pump. The hydraulic pump 14 draws fluid from a reservoir 16 and provides the fluid to an actuator 18. The actuator 18 includes a piston 24 that is movably mounted within a cylinder bore 26. The piston 24 divides the cylinder bore 26 into first and second chambers 28 and 30, respectively. The first chamber 28 may be referred to as a piston (or head) side chamber and, the second chamber 30 may be referred to as a rod side chamber. A rod 32 of the actuator 18 which is affixed to or integral to the piston 24 extends through the second chamber 30 and outwardly of a housing 40 (FIG. 2) of the electro-hydraulic actuator 100.

The electro-hydraulic actuator 100 is operable for extending or retracting the rod 32 relative to the housing 40 for causing relative movement of two structures, one attached to the housing and the other attached to the rod. To extend the rod 32 of the electro-hydraulic actuator 100, the electric motor 12 is operated to drive the hydraulic pump 14 in a first rotational direction causing hydraulic fluid drawn from the reservoir 16 and chamber 36 to be directed into the first chamber 28 of the actuator 18. The fluid directed into the first chamber 28 creates a pressure differential between the first and second chambers 28 and 30 of the actuator 18 that moves the piston 24 to increase the volume of the first chamber 28 and decrease the volume of the second chamber 30, thus extending the rod 32. To retract the rod 32, the electric motor 12 is operated to drive the hydraulic pump 14 in a second rotational direction, opposite the first rotational direction, causing hydraulic fluid drawn from the chamber 28 to be directed into the second chamber 30 of the actuator 18. The fluid directed into the second chamber 30 creates a pressure differential in which the pressure in the second chamber is higher than that in the first chamber 28. As a result of the differential pressure, the piston 24 moves to increase the volume of the second chamber 30 and decrease the volume of the first chamber 28, thus retracting the rod 32.

Figure 2:
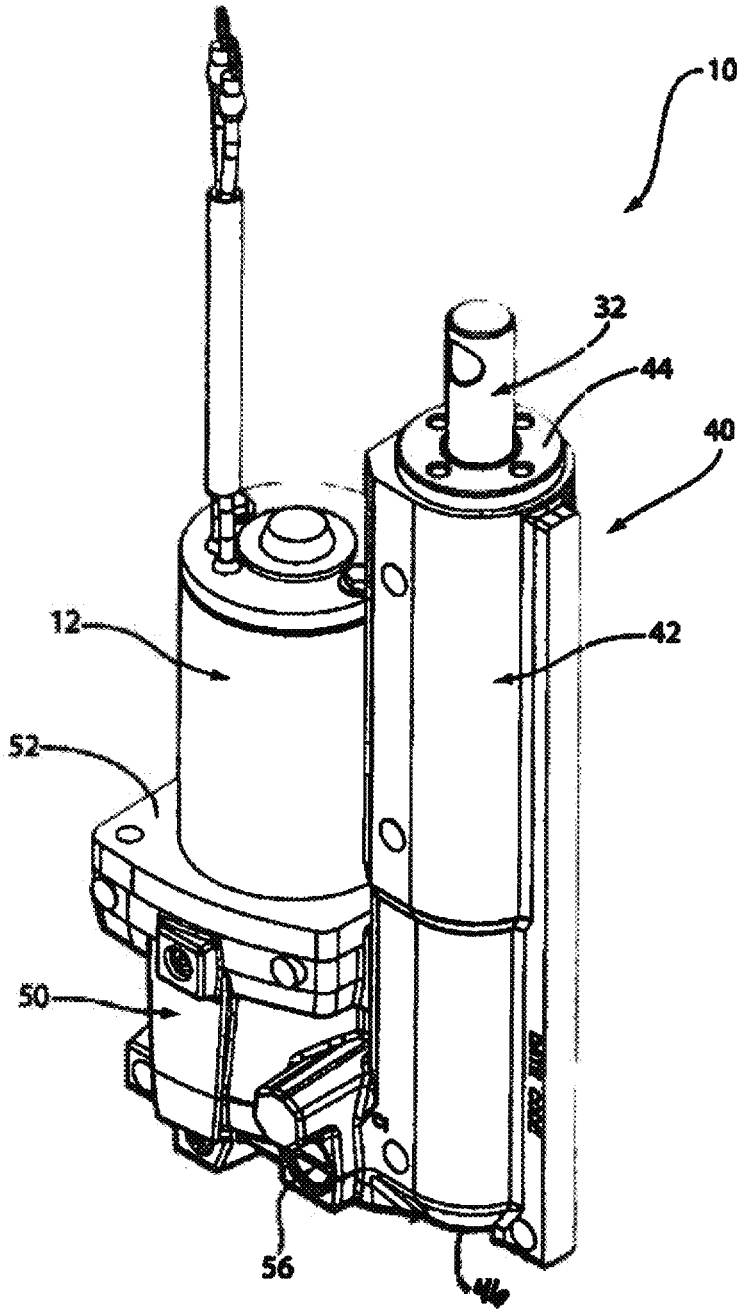
FIG. 2 is perspective view of an embodiment of the electro-hydraulic actuator of the present invention.
Figure 3:
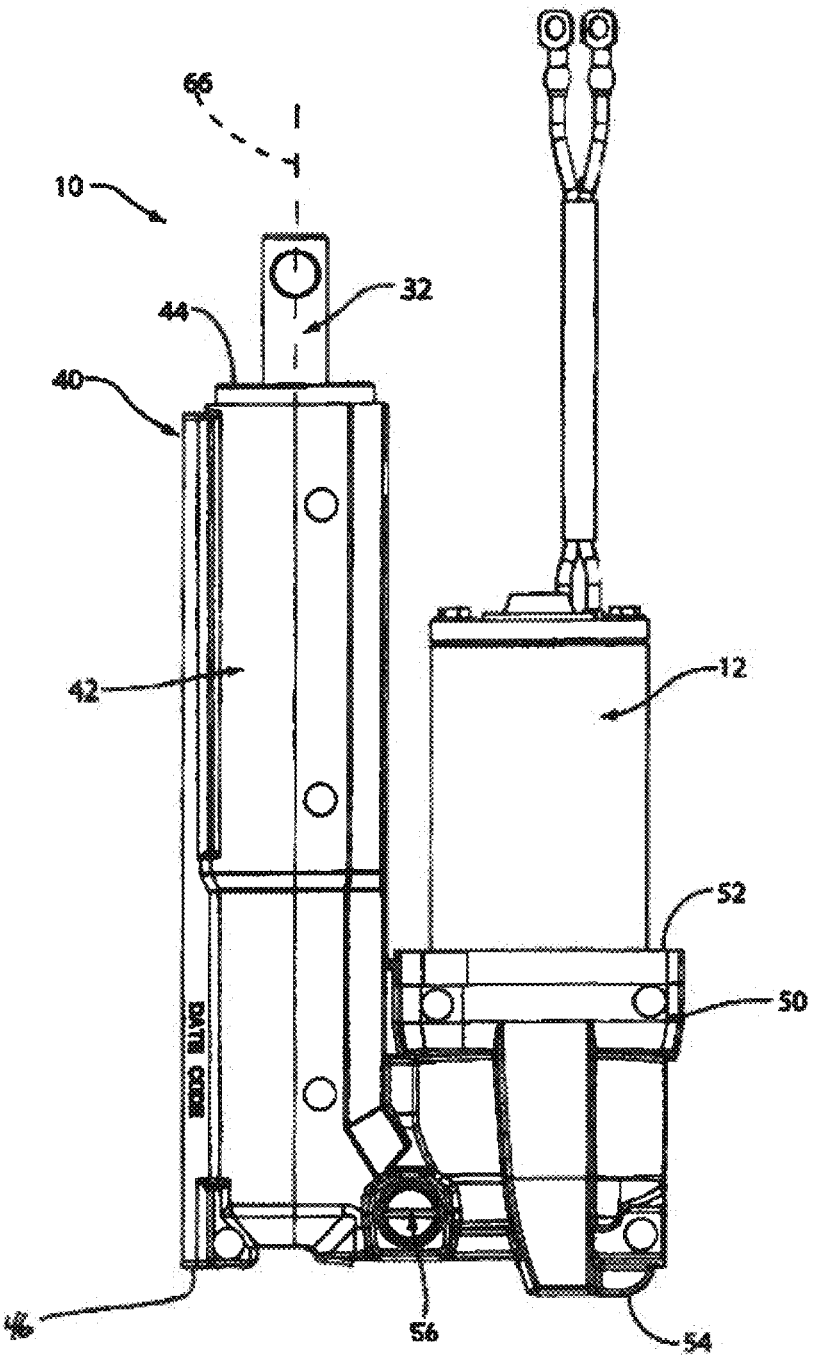
FIG. 3 is a side elevational view of the electro-hydraulic actuator shown in FIG. 2.

For reference purposes, FIGS. 2 and 3 illustrate an assembled electro-hydraulic actuator 10 of the type used in an embodiment of the present invention. As shown in FIG. 2, the electro-hydraulic actuator 10 includes a housing 40. The housing 40 includes (i) an actuator portion 42 having opposite first and second ends 44 and 46 (FIG. 3), respectively, and (ii) a drive device portion 50 having opposite first and second ends 52 and 54, respectively. As best shown in FIG. 3, the actuator portion 42 and drive device portion 50 of the housing 40 are interconnected adjacent their respective second ends 46 and 54. Fluid flow conduits located internal to the housing 40 extend between the actuator portion 42 and the drive device portion 50. The portion of the housing 40 having the flow conduits is commonly referred to as the manifold.

The drive device portion 50 of the housing 40 supports the drive components of the electro-hydraulic actuator 10. The drive components include at least the electric motor 12 and a hydraulic pump 14. In one embodiment, the hydraulic pump 14 is a gerotor type pump that is located within the drive device portion 50 of the housing 40. Those skilled in the art will recognize that any one of various types of hydraulic pumps may be used. The reservoir 16 is also located within the drive device portion 50 of the housing 40 adjacent the second end 54. Also, as illustrated, the housing of the electric motor 12 extends outwardly of a first end 52 of the drive device portion 50 of the housing 40. Those skilled in the art will recognize that a separate reservoir, such as a plastic reservoir, may be used with the electro-hydraulic actuator 10. Further, the motor 12 may be located, if desired, within the drive device portion 50 of the housing 40, in which case the drive device portion may be elongated relative to that illustrated. For simplifying the packaging, the drive device portion 50 of the electro-hydraulic actuator 10 illustrated includes an integral reservoir 16 that is cast in the drive device portion during casting of the housing 40.

An interior surface of the actuator portion 42 of the housing 40 defines the cylinder bore 26 of the electro-hydraulic actuator 10. The cylinder bore 26 extends into the actuator portion 42 of the housing 40 from the first end 44 and terminates at an end wall (not shown) located a spaced distance from the second end 46. Various sealing components and closure methods may be used for closing the opening to the cylinder bore 26 located on first end 44 of the actuator portion 42 and sealing about the rod 32, when installed. The cylinder bore 26 may be cast in the actuator portion 42 during casting of the housing 40 and later machined to its desired diameter.

As set forth above, a piston 24 is located in the cylinder bore 26 of the assembled electro-hydraulic actuator 10 for dividing the cylinder bore into the first and second chambers 28 and 30. Various known sealing methods for sealing the circumference of the piston 24 may be used to prevent fluid flow between the first and second chambers 28 and 30. Movement of the piston 24 upward, as viewed in FIG. 1, results in an extension of the rod outwardly of the first end 44 of the actuator portion 42. Movement of the piston 24 downward, as viewed in FIG. 1, results in a retraction of the rod 32 relative to the first end 44 of the actuator portion 42 of the housing 40.

In one embodiment, the EHA is designed for off-road mobile applications. Thus, when used, for example, to move a door of a vehicle, the EHA is capable of opening and closing the door when the vehicle is located on various slopes. A conventional EHA used for this application has one major deficiency, when a load is actuated and an external force (such as gravity) is working in the same direction as the direction of movement of the actuator of the EHA, there is the potential that the load (or object, such as the door) being moved will travel faster than the maximum rate the actuator is capable of moving. As a result, one of two issues occurs, both of which are commonly referred to as "run-away" (1) the load travels rapidly and out of control to the physical limits of the EHA, or (2) if pressure operated check valves are utilized in the of the EHA, the internal system pressure drops to a level insufficient to hold the valve open and the load appears to shudder through the length of travel creating excessive noise and potential damage to mechanical components.

Figure 4:
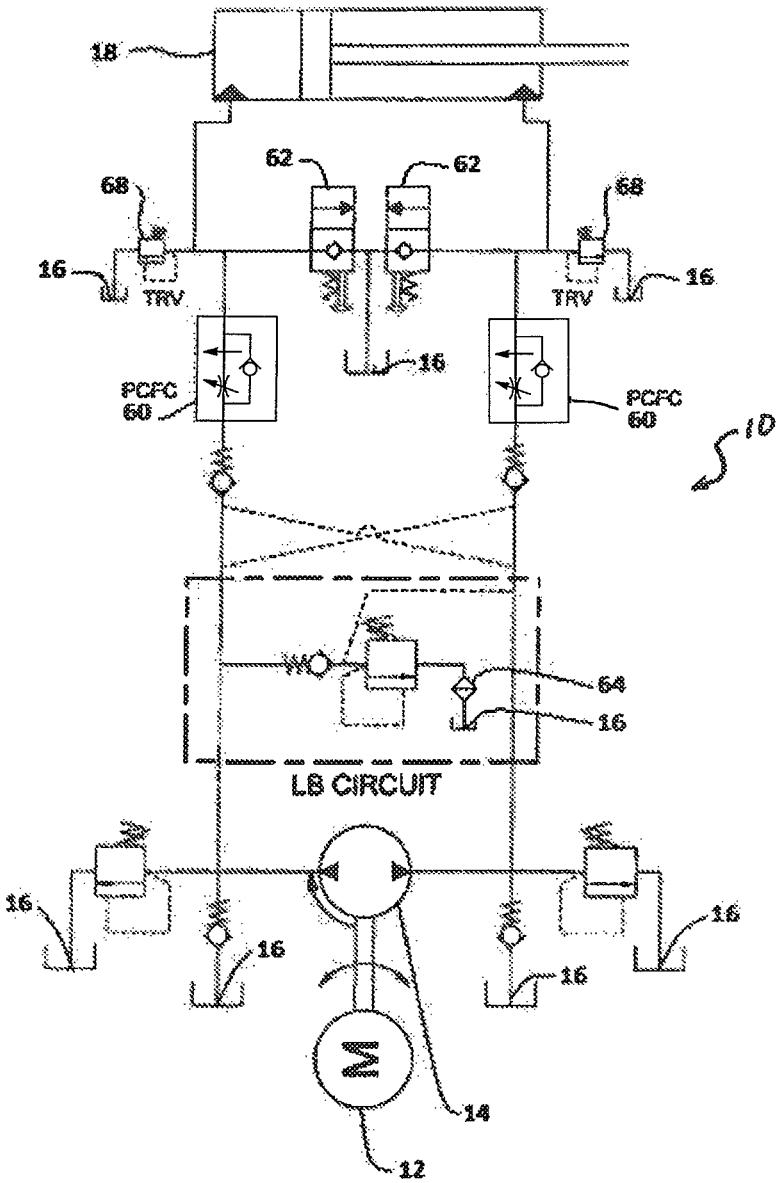
FIG. 4 is a schematic illustration of a hydraulic circuit of an embodiment of the electro-hydraulic actuator of the present invention.

These issues are addressed with the current design by integrating into the EHA pressure compensated flow control (PCFC) valves 60, as is shown by the schematic diagram of the EHA 10 in FIG. 4. The PCFC valves 60 limit the maximum flow rate through the hydraulic circuit 10 regardless of the loads imparted on the actuator 18. By adding the PCFC valves 60 to the EHA 10, the hydraulic circuit of the EHA 10 maintains a minimum internal pressure sufficient to keep the pressure operated check valves operating correctly as well as maintaining an acceptable flow rate to prevent the load from moving faster than the controlled speed, i.e., the speed at which the controller (or operator) desires to move the actuator.

In FIG. 4, when the manual operation is engaged by activating the of manual valves 62, the actuator 18 is able to move quickly as the manual valves 62 are fluidly directly connected to the actuator 18 such that there is nothing to inhibit the flow of the hydraulic fluid. This can be important in a situation where the EHA 10 operates a door such as in a military vehicle and power is lost to the hydraulic system. In the manual mode, the door can be opened and/or closed quickly by hand.

Figure 5:
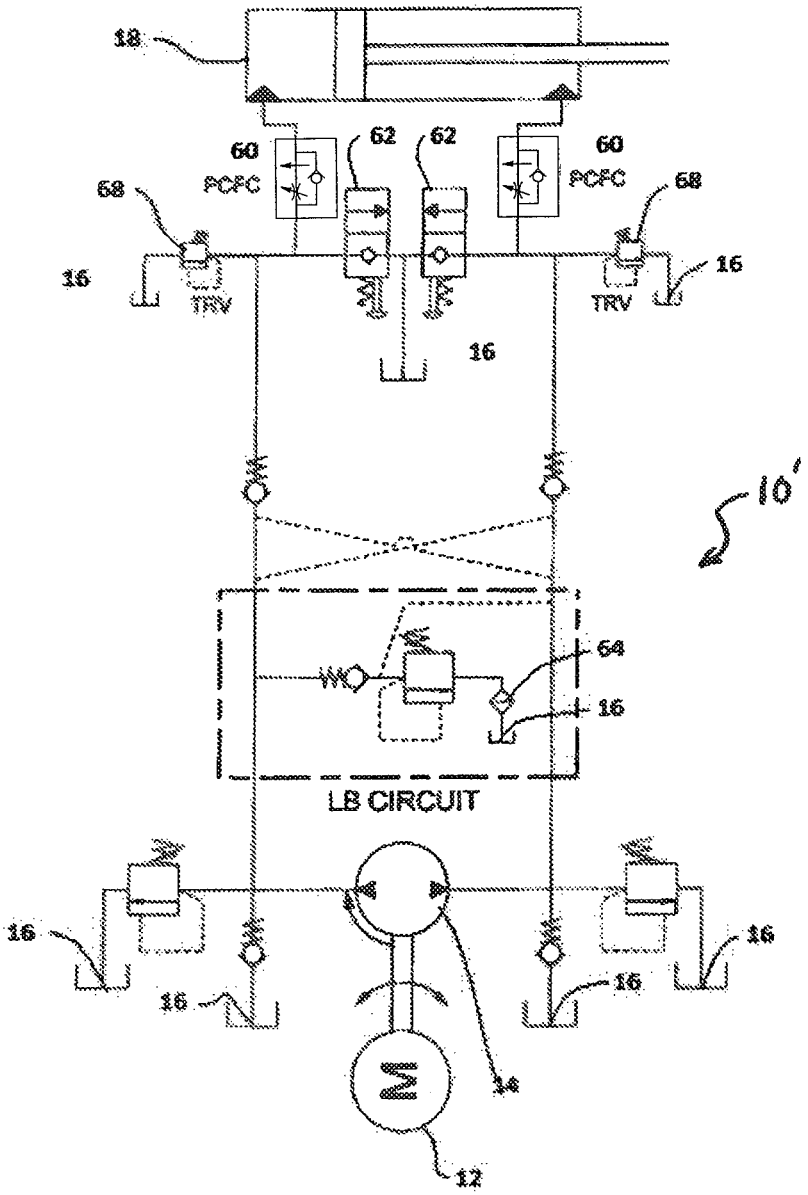
FIG. 5 is a schematic illustration of another hydraulic circuit of an embodiment of the electro-hydraulic actuator of the present invention.

An alternative embodiment of the EHA 10' having the PCFC valves 60 is shown in FIG. 5. In this embodiment, the PCFC valves 60 are positioned between the manual valves 62 and the actuator 18. When the manual operation is engaged by activating the of manual valves 62, the actuator 18 is not able to move as quickly as in the previous embodiment as the fluid must travel through the PCFC valves 60. This provides a load that is under control. In a door system utilizing EHA 10' the door will still manually open and shut easily, but the movement will be slower and controlled.

Incorporating the PCFC valves into the EHA 10, 10' provides for a more robust and repeatable functionality of the system while maintaining the appeal of having an entirely self-contained hydraulic system.

To save space and weight, the EHA 10, 10' is designed as a bi-rotational device meaning that during actuation, the fluid from on chamber of the actuator is pumped to the other chamber of the actuator 18. As such, the minimum amount of fluid needed in the reservoir of the EHA 10, 10' is the differential volume created by the volume of the rod when the actuator is fully retracted.

In conventional EHAs, the reservoir volume is filtered on the suction line of the pump while the rod is being extended. This solution relies on the vacuum created by the pump suction to draw fluid through the filter. As a result, potential problems may occur at extreme cold temperatures when the fluid viscosity increased. Such problem could include cavitation of the pump due to the lack of flow to the pump through the filter. To avoid these potential problems, the filter incorporated into the conventional EHA is oversized so as to avoid excessive pressure drop.

As shown in FIGS. 4 and 5, the EHA 10, 10' of the present invention incorporates a filter 64 on the discharge of fluid to the reservoir 16 as the rod 32 either retracts or extends. Thus, fluid is filtered after use and as it is returned to the reservoir 16. The pump suction draws the filtered fluid directly from reservoir 16 without the need for further filtering. The advantage of this design is that the fluid is pressurized as it passes through the filter 16 and the risk of cavitation is avoided. As a result, the filter 16 can be downsized from the conventional design, thereby reducing weight and size of the EHA 10, 10'.

Two valves commonly incorporated into any compact mobile hydraulic assembly include a valve (or multiple valves) to allow manual override of the system (commonly, a manually operated bypass) and a valve to address thermal expansion of fluid. The manual override valve enables the actuation of the system in the event of an external power failure. The thermal valve bleeds off excess system pressure that may be created due to thermal expansion of fluid due to factors such as temperature variations or system pressure spikes due to sudden impact or loading on the system.

Figure 6A:
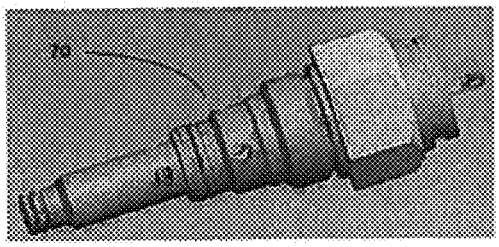
FIG. 6*a* is a perspective view of an integrated manual and thermal valve used in an embodiment of the electro-hydraulic actuator of the present invention.
Figure 6B:
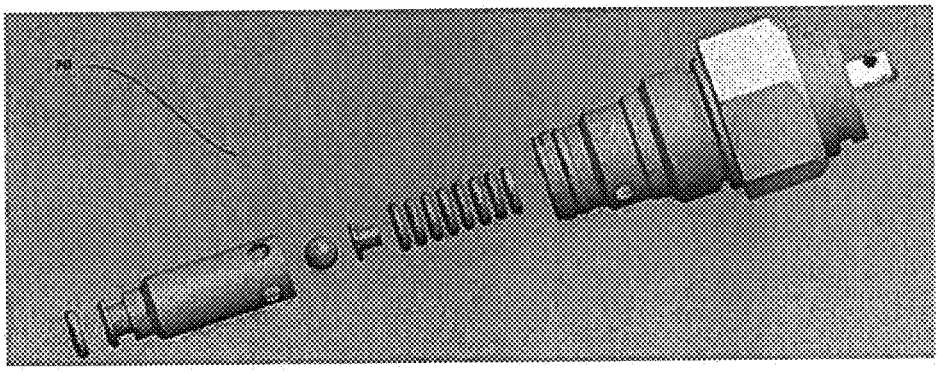
FIG. 6*b* is an exploded perspective view of the integrated manual and thermal valve shown in FIG. 6*a;*
Figure 6C:
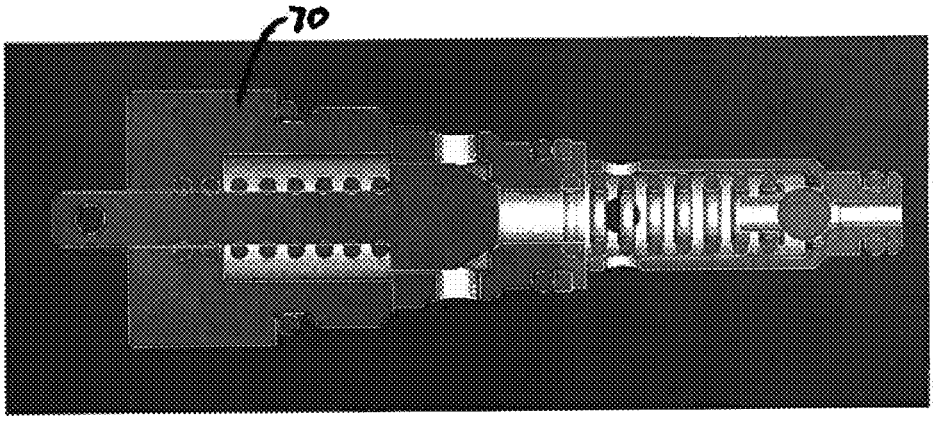
FIG. 6*c* a is a cross-sectional view of the integrated manual and thermal valve shown in FIG. 6*a* with both valves closed.
Figure 6D:
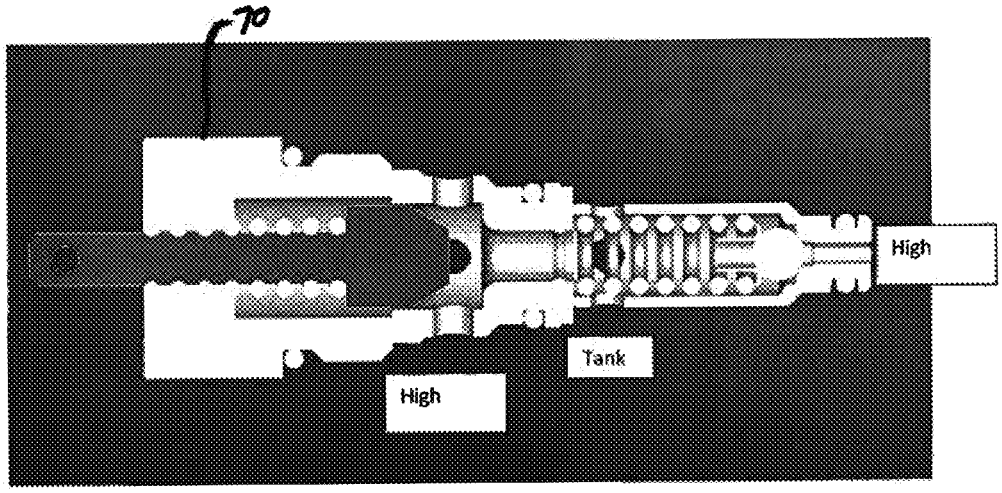
FIG. 6*d* a is a cross-sectional view of the integrated manual and thermal valve shown in FIG. 6*a* with the manual valve open and the thermal valve closed.
Figure 6E:
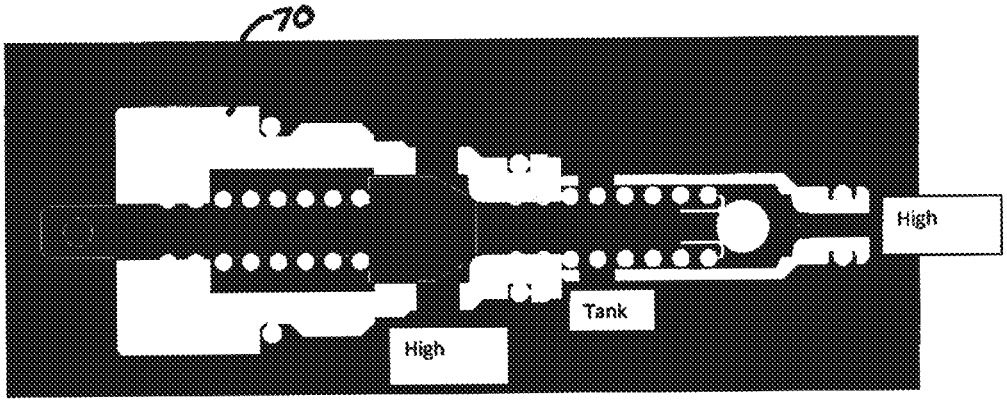
FIG. 6*e* is a cross-sectional view of the integrated manual and thermal valve shown in FIG. 6*a* with the manual valve closed and the thermal valve open.
Figure 7:
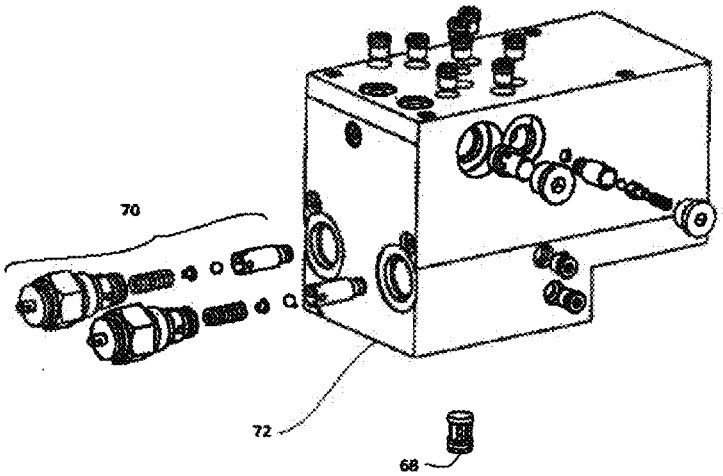
FIG. 7 is an exploded perspective view of the manifold of the EHA adapted for receiving the combination manual override, thermal expansion valves.

The EHA of the present invention includes a combination manual release, thermal expansion valves 70 which has incorporated both of these functions (manual override and thermal expansion) and which is installed into the manifold 72 of the housing 40 of the EHA 10, 10', and which corresponds with the positioning of manual valves 62 in FIGS. 4-5. As a result, the manifold 72 uses common flow paths for the combination manual release, thermal expansion valves 70. The end result being that the system is easier to manufacture due to fewer machining operations, as well as a lighter weight and more compact versus prior systems. FIG. 6*a* and 6*b* illustrated the integrated manual override and thermal valves 70. FIGS. 6*c*-6*e* show cross-sectional views of the integrated manual override and thermal valves 70 in a closed condition (FIG. 6*c*) and both open conditions (FIGS. 6*d* and 6*e*). FIG. 7 illustrate the manifold 72 of the EHA 10, 10; adapted for receiving the combination manual override, thermal expansion valves 70.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

What is claimed is:

1. An electro-hydraulic actuator having:

a hydraulic pump;

an electric motor operatively connected to the hydraulic pump and operable for driving the pump;

an actuator movable in response to fluid flow from the pump, the actuator including a piston movable in a cylinder and defining a piston side chamber and a rod side chamber;

a housing for the pump, electric motor and actuator and including a reservoir, the housing including a manifold with fluid conduits for connecting the reservoir, the pump and the piston side and rod side chambers of the actuator;

a plurality of pressure compensated flow control valves adapted to limit the maximum flow rate through the fluid conduits regardless of loads imparted on the actuator; and a plurality of combination manual release, thermal expansion valves received in the manifold and positioned in the fluid conduits.

2. The electro-hydraulic actuator of claim 1 further comprising a filter for filtering fluid as the fluid returns to the reservoir from the actuator.

3. The electro-hydraulic actuator of claim 1, wherein the plurality of pressure compensated flow control valves are fluidly directly connected to the actuator.

4. The electro-hydraulic actuator of claim 1 wherein the combination manual release, thermal expansion valves are adapted to provide a fluid connection between the actuator and the reservoir when the manual release valves are manually actuated.

5. The electro-hydraulic actuator of claim 4, wherein the plurality of pressure compensated flow control valves are each fluidly connected between a respective end of the actuator and a respective manual release valve.

6. An electro-hydraulic actuator having:

a hydraulic pump;

an electric motor operatively connected to the hydraulic pump and operable for driving the pump;

an actuator movable in response to fluid flow from the pump, the actuator including a piston movable in a cylinder and defining a piston side chamber and a rod side chamber;

a housing for the pump, electric motor and actuator and including a reservoir, the housing including a manifold with fluid conduits for connecting the reservoir, the pump and the piston side and rod side chambers of the actuator;

a plurality of pressure compensated flow control valves adapted to limit the maximum flow rate through the fluid conduits regardless of loads imparted on the actuator; and a plurality of manual release valves adapted to provide a fluid connection between the actuator and the reservoir when the manual release valves are manually actuated; and wherein the plurality of manual release valves are fluidly connected directly to the actuator.

7. The electro-hydraulic actuator of claim 6, wherein each manual release valve is also a thermal compensation valve.

8. An electro-hydraulic actuator having:

a hydraulic pump;

an electric motor operatively connected to the hydraulic pump and operable for driving the pump;

an actuator movable in response to fluid flow from the pump, the actuator including a piston movable in a cylinder and defining a piston side chamber and a rod side chamber;

a housing for the pump, electric motor and actuator and including a reservoir, the housing including a manifold with fluid conduits for connecting the reservoir, the pump and the piston side and rod side chambers of the actuator;

a plurality of pressure compensated flow control valves adapted to limit the maximum flow rate through the fluid conduits regardless of loads imparted on the actuator; and a filter for filtering fluid as the fluid returns to the reservoir from only the piston side chamber of the actuator.

9. The electro-hydraulic actuator of claim 8, wherein the plurality of pressure compensated flow control valves are fluidly directly connected to the actuator.

10. The electro-hydraulic actuator of claim 8 further comprising a plurality of combination manual release, thermal expansion valves received in the manifold and positioned in the fluid conduits.

11. The electro-hydraulic actuator of claim 10, wherein the plurality of pressure compensated flow control valves are each fluidly connected between a respective end of the actuator and a respective combination manual release, thermal expansion valve.

12. The electro-hydraulic actuator of claim 10, wherein the plurality of combination manual release, thermal expansion valves are fluidly connected directly to the actuator.

13. An electro-hydraulic actuator having:

a hydraulic pump;

an electric motor operatively connected to the hydraulic pump and operable for driving the pump;

an actuator movable in response to fluid flow from the pump, the actuator including a piston movable in a cylinder and defining a piston side chamber and a rod side chamber;

a housing for the pump, electric motor and actuator and including a reservoir, the housing including a manifold with fluid conduits for connecting the reservoir, the pump and the piston side and rod side chambers of the actuator; and a plurality of combination manual release, thermal expansion valves received in the manifold.

14. The electro-hydraulic actuator of claim 13 further comprising a filter for filtering fluid as the fluid returns to the reservoir from the actuator.

15. The electro-hydraulic actuator of claim 13 further comprising a plurality of pressure compensated flow control valves adapted to limit the maximum flow rate through the fluid conduits regardless of loads imparted on the actuator.

16. The electro-hydraulic actuator of claim 15, wherein the plurality of pressure compensated flow control valves are fluidly directly connected to the actuator.

17. The electro-hydraulic actuator of claim 13, wherein the plurality of pressure compensated flow control valves are each fluidly connected between a respective end of the actuator and a respective combination manual release, thermal expansion valve.

18. The electro-hydraulic actuator of claim 13, wherein the plurality of combination manual release, thermal expansion valves are fluidly connected directly to the actuator.

* * * * *